US009494388B2

(12) United States Patent
Crye et al.

(10) Patent No.: US 9,494,388 B2
(45) Date of Patent: Nov. 15, 2016

(54) VENTED BALLISTIC COMBAT HELMET

(75) Inventors: Caleb Clark Crye, Brooklyn, NY (US); Eric Owen Fehlberg, Queens, NY (US); Gregg M. Thompson, Brooklyn, NY (US); Scott Thompson, Bridgewater, NJ (US)

(73) Assignee: LINEWEIGHT LLC, Brooklyn, NY (US)

( * ) Notice: Subject to any disclaimer, the term of this patent is extended or adjusted under 35 U.S.C. 154(b) by 1830 days.

(21) Appl. No.: 11/934,269

(22) Filed: Nov. 2, 2007

(65) Prior Publication Data

US 2012/0167268 A1 Jul. 5, 2012

Related U.S. Application Data

(60) Provisional application No. 60/864,362, filed on Nov. 3, 2006.

(51) Int. Cl.
*F41H 1/04* (2006.01)
*A42B 3/28* (2006.01)

(52) U.S. Cl.
CPC . *F41H 1/04* (2013.01); *A42B 3/28* (2013.01); *A42B 3/281* (2013.01)

(58) Field of Classification Search
CPC ..... A42B 3/06; A42B 3/063; A42B 3/28; F41H 1/04; F41H 1/08
USPC ..... 2/410, 6.4, 6.5, 6.6, 411, 412, 416, 421; 89/36.05
See application file for complete search history.

(56) References Cited

U.S. PATENT DOCUMENTS

| | | | | |
|---|---|---|---|---|
| 2,181,180 | A * | 11/1939 | Feige | 2/182.6 |
| 2,383,597 | A | 8/1945 | Feman | |
| 3,030,632 | A | 4/1962 | Shelton | |
| 3,496,854 | A | 2/1970 | Feldmann et al. | |
| 3,514,787 | A * | 6/1970 | Kennedy, Jr. | 2/410 |
| 3,786,519 | A | 1/1974 | Aileo | |
| 4,023,209 | A | 5/1977 | Frieder, Jr. et al. | |
| 4,028,739 | A | 6/1977 | Bell et al. | |

(Continued)

FOREIGN PATENT DOCUMENTS

| | | |
|---|---|---|
| GB | 2358787 A | 8/2001 |
| WO | 0051456 A1 | 9/2000 |
| WO | 0057739 A1 | 10/2000 |

OTHER PUBLICATIONS

U.S. Appl. No. 60/895,654.

(Continued)

*Primary Examiner* — Shaun R Hurley
*Assistant Examiner* — Andrew W Sutton
(74) *Attorney, Agent, or Firm* — Stiennon & Stiennon

(57) ABSTRACT

A ballistic armor helmet has two or more shell elements which are fixed to one another to define one or more ventilation gaps. The shell elements preferably overlap to keep projectiles from entering the helmet. By dividing the helmet into two or more parts, the depth and extent of the compound curvature of the shells being formed can be reduced, reducing or eliminating the need for gores, by bringing the depth of the compound curves within the inherent formability of polymer coated ballistic fabrics. The helmet more efficiently uses materials, and promotes cooling when in use, resulting in a helmet which covers a greater percentage of the head which is more comfortable and less costly.

6 Claims, 6 Drawing Sheets

(56) References Cited

U.S. PATENT DOCUMENTS

| | | | | |
|---|---|---|---|---|
| 4,307,471 | A * | 12/1981 | Lovell | 2/411 |
| 4,404,690 | A | 9/1983 | Farquharson | |
| 4,622,700 | A | 11/1986 | Sundahl | |
| 5,010,598 | A | 4/1991 | Flynn et al. | |
| 5,012,533 | A | 5/1991 | Raffler | |
| 5,056,156 | A * | 10/1991 | Kosmo et al. | 2/411 |
| 5,628,071 | A * | 5/1997 | Nezer | 2/410 |
| 5,953,761 | A * | 9/1999 | Jurga et al. | 2/425 |
| 6,247,186 | B1 * | 6/2001 | Huang | 2/410 |
| 6,324,700 | B1 * | 12/2001 | McDougall | 2/417 |
| 6,381,760 | B1 | 5/2002 | Lampe et al. | |
| 6,804,829 | B2 | 10/2004 | Crye et al. | |
| 6,910,228 | B2 | 6/2005 | Tanaka | |
| 6,961,963 | B2 | 11/2005 | Rosie | |
| 7,987,525 | B2 * | 8/2011 | Summers et al. | 2/425 |
| 2004/0187195 | A1 | 9/2004 | Lee | |
| 2004/0255364 | A1 * | 12/2004 | Feher | 2/171.3 |
| 2005/0166303 | A1 | 8/2005 | Aaron | |
| 2006/0230506 | A1 * | 10/2006 | Shirai et al. | 2/410 |
| 2006/0248623 | A1 | 11/2006 | Miller | |
| 2007/0079429 | A1 * | 4/2007 | Pilon et al. | 2/410 |
| 2008/0109946 | A1 * | 5/2008 | Jourde et al. | 2/410 |
| 2009/0031480 | A1 * | 2/2009 | Torres | 2/413 |
| 2009/0188022 | A1 * | 7/2009 | Durocher et al. | 2/414 |
| 2010/0005573 | A1 * | 1/2010 | Rudd et al. | 2/414 |
| 2011/0047679 | A1 * | 3/2011 | Rogers et al. | 2/414 |
| 2011/0179557 | A1 * | 7/2011 | Rabie | 2/411 |
| 2012/0144564 | A1 * | 6/2012 | Alexander et al. | 2/410 |
| 2012/0167268 | A1 * | 7/2012 | Crye et al. | 2/6.6 |

OTHER PUBLICATIONS

Supplementary European Search Report for PCT/US2007/083475 dated Jan. 14, 2013.

BulletproofME.com Body Armour—Ballistic Protection Levels [online] Feb. 15, 2004: <URL:http://www.bulletproofme.com/Ballistic_Protection_Levels.shtml.>.

International Search Report for PCT/US07/83475 dated Jul. 27, 2008.

* cited by examiner

VENTED BALLISTIC COMBAT HELMET

CROSS REFERENCES TO RELATED APPLICATIONS

This application claims the benefit of U.S. provisional app. 60/864,362, filed Nov. 3, 2006, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to ballistic armor helmets in general and ballistic armor helmets constructed of more than one piece in particular.

From at least the earliest days of recorded history soldiers have worn helmets to protect their head from injuries from blows and projectiles. Even today a major location of lethal battlefield injuries remains the head. There is a continued importance of maximizing protection for the head in the form of a helmet. Helmets have always had two problems which limited their effectiveness: one is weight, the other is comfort. If the helmet weighs too much it interferes with movement of the head, if the helmet is too uncomfortable it is difficult to make the soldiers wear them at all times. In modern times the problem of greater ballistic protection without debilitating weight has been addressed through the use of composite armor fabricated from ballistic fabrics such as Kevlar® material, a type of Aramid fiber ballistic Nylon®, a meta-aramid such as Nomex® fibers, Twaron® a para-aramid fiber, and Spectra® fibers, an extended-chain ultra-high molecular weight polyethylene fiber, in a matrix of thermoset or thermoplastic material, or using structural reaction injection molding (RIM) technology. Comfort, particularly thermal comfort, can be addressed by limiting the areas of the head protected.

The downside of composite ballistic armor is substantial additional cost, and the downside of limiting the area of head protection is greater vulnerability to lethal or debilitating head injury. With weight controlled through the use of a lightweight ballistic fiber composite armor the major factor in comfort, particularly in hot climates, is the natural insulating and heat retention function of a hat or helmet. A large fraction of body cooling takes place through the head. To the extent a helmet prevents heat loss from the head, particularly in warm climates, real problems of considerable discomfort and even heat exhaustion or heat stroke can result. What is needed is a ballistic armored helmet which is less costly, cooler, and provides greater coverage of a soldier's head. If these three factors could be combined their benefits would be more than additive, producing synergistic reduction in battlefield losses. A less costly helmet is available to more soldiers, a cooler helmet is worn more consistently and results in less head-related casualties, and a helmet of greater coverage provides greater protection.

SUMMARY OF THE INVENTION

The ballistic combat helmet of this invention accomplishes three objectives, lower cost, cooler operation, and greater ballistic protection, through the use of multiple shell pieces assembled together to make a single helmet. Multiple shell pieces allow for the provision of one or more air vents which allow movement of air through the helmet which provides transpirational cooling, especially in hot and dry climates where sweat evaporates from the soldier's head and is readily absorbed by the dry air. The cost of the modern ballistic material is increased for deep compound curves which cannot be developed. The ballistic fabric which is layered to create the armor has limited ability to be deformed in more than one plane. Therefore in order to form non-developable surfaces such as those employed in conventional helmet shapes, the material must be cut and formed as overlapping gores which inefficiently uses material because of the necessary overlap the scrap produces and the cost of the number of cuts in the cloth. By dividing the helmet into two or more parts, the depth and extent of the compound curvature of the shells being formed can be reduced, reducing or eliminating the need for gores, by bringing the depth of the compound curves within the inherent formability of polymer coated ballistic fabrics. The present helmet more efficiently uses materials, and promotes cooling when in use, resulting in a helmet which covers a greater percentage of the head which is more comfortable and less costly.

The combat helmet has a ballistic shell which is composed of a first piece with a second piece connected thereto to define a vent gap therebetween. The pieces of the ballistic shell, while spaced apart to form a vent, will preferably overlap to keep projectiles from entering the helmet. In an alternative arrangement, a 3-piece shell may be formed with two vents, one located at each joining of two pieces. By using three pieces, each shell piece has even less of a compound curvature, increasing the ease of forming it.

It is a feature of the present invention to provide a ballistic helmet which provides greater cooling to the wearer.

It is another feature of the present invention to provide a ballistic helmet of lower cost by more efficient use of materials and greater ease in manufacture.

It is a further feature of the present invention to provide a ballistic helmet which provides greater protection to the wearer.

It is yet another feature of the present invention to provide a type of ballistic helmet which can be designed and manufactured more easily to conform to a set of requirements.

Further objects, features and advantages of the invention will be apparent from the following detailed description when taken in conjunction with the accompanying drawings.

DESCRIPTION OF THE PREFERRED EMBODIMENTS

Figure 1:
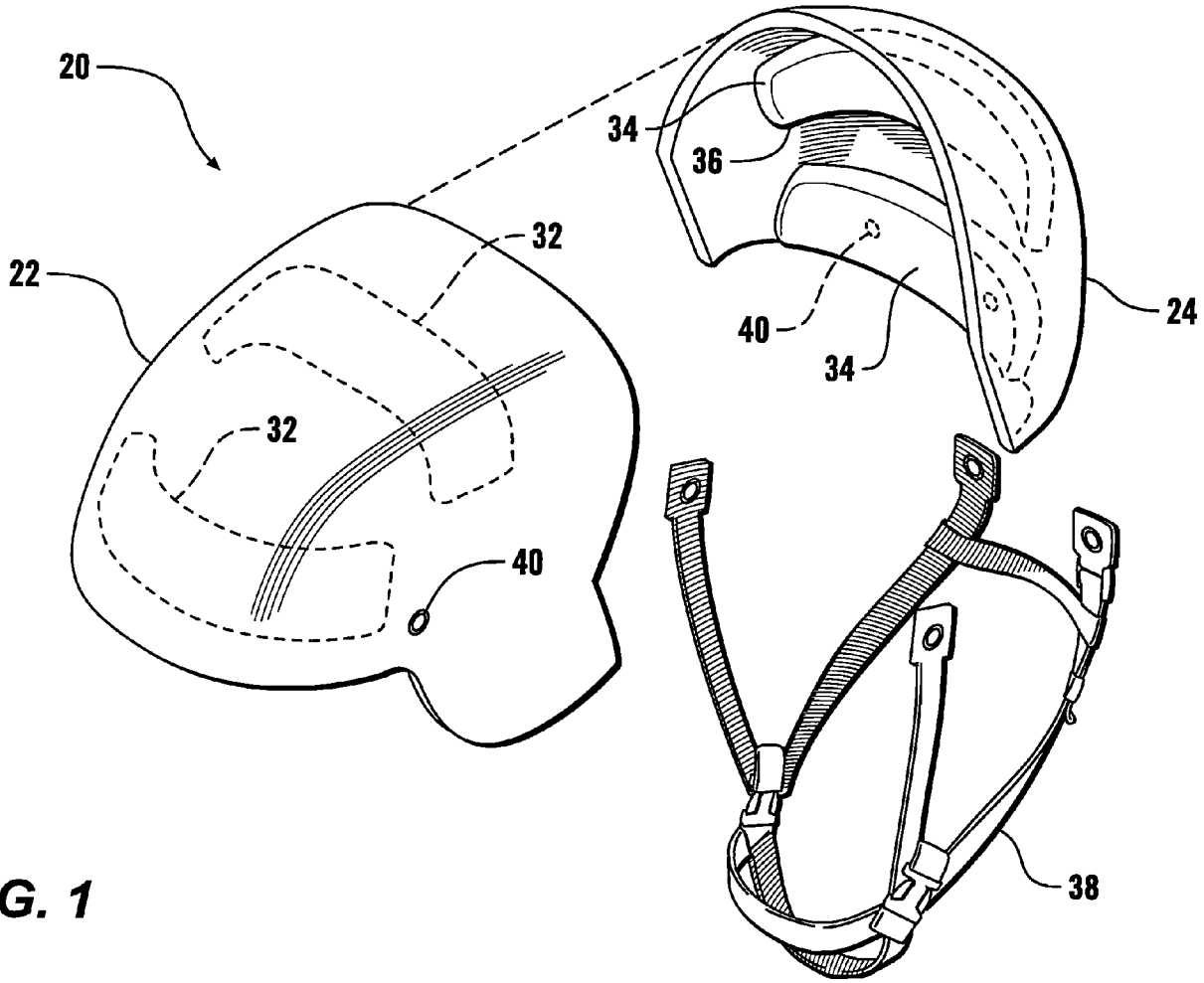
FIG. 1 is an exploded isometric view of a two-part ballistic helmet of this invention.
Figure 2:
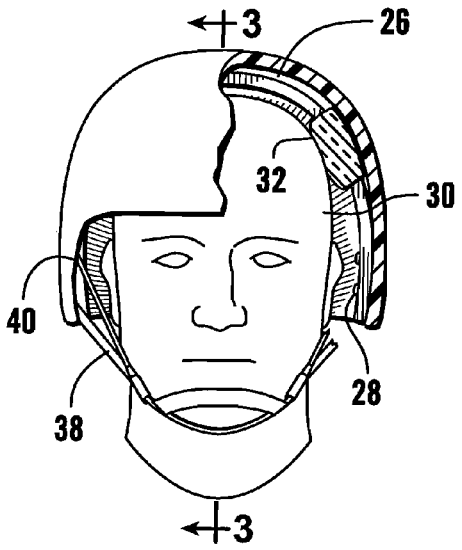
FIG. 2 is a front elevational view, partially cut away, of the two-part ballistic helmet of FIG. 1, illustrated as worn by a person.
Figure 3:
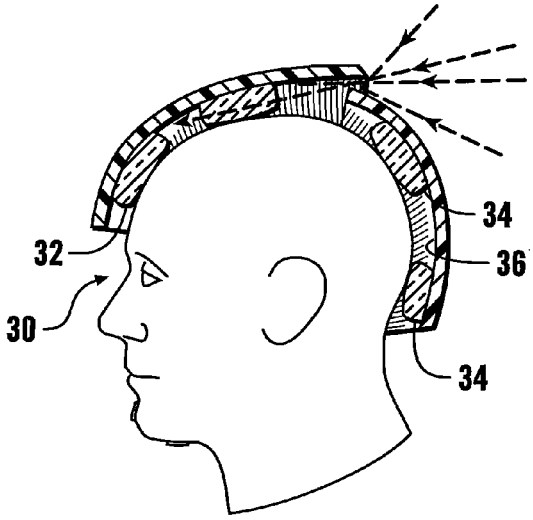
FIG. 3 is a side elevational cross-sectional view of the two-part ballistic helmet of FIG. 2, taken along section line 3-3, illustrated as worn by a person.
Figure 4:
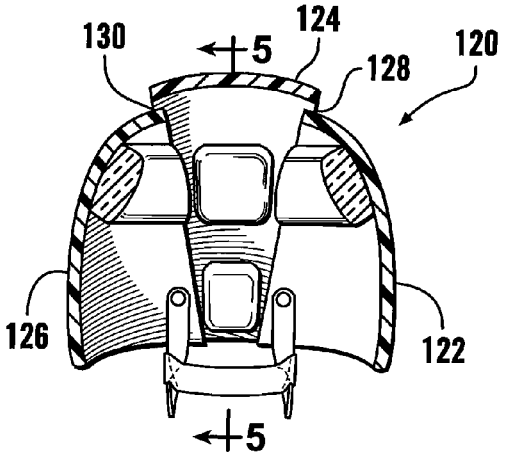
FIG. 4 is a front elevational cross-sectional view of an alternative embodiment three-part ballistic helmet.
Figure 5:
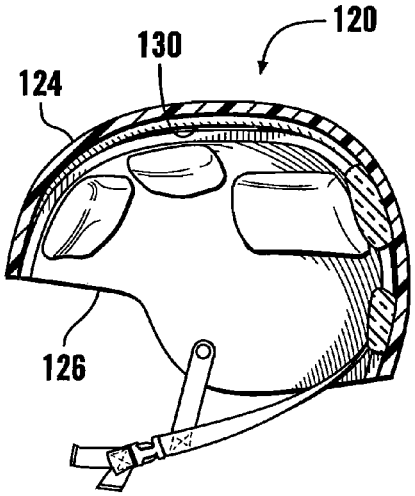
FIG. 5 is a side elevational cross-sectional view of the ballistic helmet of FIG. 4 taken along section line 5-5.

Referring more particularly to FIGS. 1-14, wherein like numbers refer to similar parts a ballistic helmet 20 is illustrated in FIG. 1-3. The helmet has a front portion 22 and a rear portion 24 which are joined together to form the helmet 20. Both the front portion 22 and the rear portion define distinctly formed shell elements, which, when assembled, define the complete ballistic protective helmet. By "ballistic protective material" is meant a material which is capable of stopping a ballistic projectile, ranging from low velocity projectiles such as various shrapnel and explosive fragments, to typical handgun rounds, to high speed rifle rounds. Ballistic protective elements will typically be rated from low, for example capable of stopping a handgun round, to high, for example capable of stopping a rifle round. An element which has a high ballistic rating is better able to protect against faster, more pointed, or more massive items impacting the element.

As shown in FIG. 3, the front portion 22 overlies the rear portion 24 and is spaced above the rear portion to form a ventilation gap 26. The ventilation gap 26 may have, for example, a width of about a quarter of an inch which tapers over 8-12 inches to the point where the two portions of the helmet meet. The front portion 22 is attached to the rear portion 24 by one or more rivets 28 as illustrated in FIG. 2, bolts or other common joining hardware, or by bonding or by a combination of riveting and bonding.

The helmet is supported on a person's head 30 as illustrated in FIGS. 2-3 by padded front spacers 32 mounted to the front portion 22 of the helmet 20, and by padded rear spacers 34 mounted to the rear portion 24 of the helmet. As illustrated in FIG. 1, the padded spacers 32,34 may be lenticular and extending along the head 30 from side to side defining air gaps or cooling passages 36 which connect directly or indirectly to the ventilation gap 26. The helmet 20 is held in place on the wearer by a webbing harness 38 which stabilizes the helmet in a conventional manner. The harness 38 is attached to the helmet 20 at attachment points 40 which may be rivets or similar fasteners. The harness has attachment points on both the rear portion 24 and the front portion 22, such that the harness connects to all the individual shell elements of the helmet 20.

The human head to a first approximation is roughly spherical, therefore a helmet which is interposed between the head and the exterior environment takes the form of a spherical shell with portions removed to accommodate the neck, provide for vision and ventilation and mobility of the head. In medieval warfare it was at least in theory possible to create a helmet that could withstand the ordinary missile weapon, and the helmets tended to enclose substantially all the head. With the advent of modern warfare, the difficulties of building a helmet of reasonable weight which can stop a rifle bullet has generally limited the modern helmet to protecting against shrapnel and fragmentary munitions. Military helmets are generally built to a NIJ Level II or Level IIIA standard which can withstand a pistol round but not a high-powered military or sport rifle. A standard base helmet typically weighs 2-3½ pounds and is manufactured of a composite formed of a ballistic fabric such as polyamide fiber in the thermoset or a thermoplastic matrix.

The typical helmet is generally hemispherical, with a downwardly depending vertical curtain around portions of the helmet away from the face. So the typical helmet is the very definition of a surface with compound curvature, i.e. nearly equal curvature in orthogonal directions. A compound surface is contrasted with a developable surface which curves in only one direction such as a cylindrical or conical surface which can be easily formed without extensive plastic deformation of the starting planar material. A compound curve, on the other hand, requires great deformation when developed from a planar surface. The basic problem is exactly the reverse of that of making a map of the Earth's surface which is spherical on a flat sheet of paper, which requires either distortion of the map or breaking the map up into star-shaped or cross-shaped gores, in a fashion similar to peeling an orange so the peel can be flattened. The generally hemispherical shape of a ballistic helmet having nearly equal curvature in two directions is most difficult to develop from flat sheets of material. By dividing the helmet into two parts, the amount of compound curvature of each part can be reduced, just as when making a map of a smaller portion of a sphere the distortion due to flattening out the sphere is less severe.

To understand the benefit of reducing the compound curvature of the parts of a ballistic helmet, one needs to understand the current state of the art in ballistic shell manufacturing techniques. Typically, a "sandwich" of many layers of resin-coated ballistic fabric is placed into a high pressure mold and is clamped under heat and pressure which catalyzes the resin coating, or defusion bonds thermoplastic resin coated ballistic fabrics, to form the final shell form. The shell wall of the helmet is usually about ⅜ inches thick. Prior to being placed in the mold the ballistic fabric must be cut in the shape of a "pinwheel", i.e. an array of triangular gores attached to a small circle of material which can be formed into a hemisphere like the gores of a parachute. If it is not cut into these shapes, bunching will occur on the sides, since the mold is a very deep nearly hemispherical compound-curved surface and the ballistic fabric is a flat element with a limited ability to stretch. These cuts in the fabric are ballistically inefficient, i.e. some overlap is necessary to obtain the strength of the uncut material. Conversely, the molds are much shallower for the shell elements of the multi-part helmet of this invention, than for a single part unitary helmet shell. In most cases it will not be necessary to cut the sheets of ballistic fabric at all. This allows the manufacturer of the parts of the helmet with to use ballistic material with few or no "pinwheel" shapes so that the final parts are as ballistically efficient as possible. At the same time, by avoiding having to cut the pinwheel shapes, less of the expensive ballistic fabric is wasted and less time is needed to prepare the fabric sandwich for molding. These production efficiencies allow more helmets to be produced for a given amount of ballistic fabric and for a given amount of time which reduces cost.

To a very rough approximation, the human head may be considered as a sphere such that the helmet which is designed to protect the head normally approximates a sphere, if constrained by minimum surface area and weight. Both surface area and resulting weight are important considerations in ballistic helmets where the level of ballistic protection, i.e. resistance to ballistic penetration, are directly related to minimizing surface area to maximize ballistic protection for a given weight of ballistic material. A helmet must normally be easily removed from the head, and if mounted to the head, must allow for mobility of the head in both rotation and tilt with respect to the body, and thus cannot extend much and has generally the shape of a hemisphere. A hemisphere is defined as one half of a sphere. If a sphere is defined as having a zenith and nadir and great circles extending through the zenith and the nadir, a hemisphere extends 90° in all directions along the great circles from the zenith toward the nadir i.e. to the equator, or the great circle which is equidistant from both the zenith and in the nadir.

A portion of a sphere is not a developable surface. If a surface is developable, than a planar surface, such as a planar fabric, can be bent without substantial distortion or stretching. A helmet however cannot be made from developable surfaces such as cones and cylinders if it is to have maximum strength and minimum size and weight. If a sheet of ballistic material is to cover a non-developable surface without being cut, it is necessary that the surface not be too greatly curved. For example, taking a helmet portion surface which is a symmetrical fraction of a hemisphere, if a full hemisphere encompasses an angle of 180 degrees in cross-section, then the helmet portion surface is most preferably up to about 120 degrees, and preferably up to about 135 degrees. In a helmet portion which is not a pure subsection of a hemisphere, these limitations may be applied to the smaller of the sections taken along the two main axes of the surface. For example, the middle portion 124 shown in FIGS. 4 and 5, has a large angle as viewed in the section running from front to back in FIG. 5, but a small angle when viewed in section running side to side in FIG. 4. In other words, each of the helmet portions should define surfaces that are substantially less than a full hemisphere, preferably less than about 75 percent of a full hemisphere (135 degrees/180 degrees).

The benefits of the ventilation gap provided by the ballistic helmet 20 constructed of two or more portions 22, 24 is greater comfort and less heat stress through the cooling action provided by the ventilation gap 26. A person doing light work outputs about 400 BTUs per hour and strenuous activity can increase that to about 1600 BTUs per hour. If one third of that heat output is to be dissipated from the head, 120 to 480 BTUs per hour must be removed. Forty cubic feet of air, if raised 10° F. will absorb 120 BTUs, or the water vapor which air at body temperature can absorb will also absorb 120 BTUs. These simple calculations indicate that the potential to remove substantial amounts of heat with an air exchange of once only every few seconds.

Whereas a conventional unitary and unventilated helmet may trap heat in the top, the present invention allows the heated air to rise out the top, thereby drawing cool air in at the lower edges of the helmet, thus aiding the body's natural evaporative cooling system by allowing sweat to be more readily evaporated into the surrounding air.

The third benefit of the multi-part shell is that it allows the helmet's protection level to be tailored for the various regions of the head—a feature which can be used to mitigate the weight issues associated with higher levels of protection. The helmet front portion 22, for instance could offer a high protection level (rifle level) while the helmet rear portion 24 could offer a lower protection level. By thus providing a greater ballistic rating for the front portion than the rear portion of the helmet, it is possible to keep the overall weight of the helmet within reason but offer an enhanced protection. Conversely, the cost and weight of making an entire rifle-protective helmet can make it unattractive to many users. Thus the front shell element can be made of thick or heavier material than the rear shell element, with the result that the front shell element has a first ratio of total weight to total exterior surface area, the rear shell element a ballistic protection level substantially less than the first protection level, and a ratio of total weight to total exterior surface area which is less than the first ratio. Even greater ballistic rating may be obtained for a portion of the helmet by attaching a ceramic or metal plate to the exterior of the helmet portion. Such a plate may be removably attached to allow the extra weight to be removed when desirable. Alternatively, an entire helmet portion may be formed with a ceramic or metal layer.

It should be noted that, because the helmet can be formed from a front portion and a rear portion, adjustable fasteners between the two portions may be provided to allow the helmet to be adjusted for the size of a wearer's head by increasing or decreasing the amount of overlap between the two portions.

It should be understood that the lenticular padded spacers 32, 34 could extend from the front to the back of the head 30, or could be discrete circles, rectangles, triangles or the like which define the multiplicity of air passages therebetween which connect directly or indirectly to the ventilation gap 26.

Figure 6:
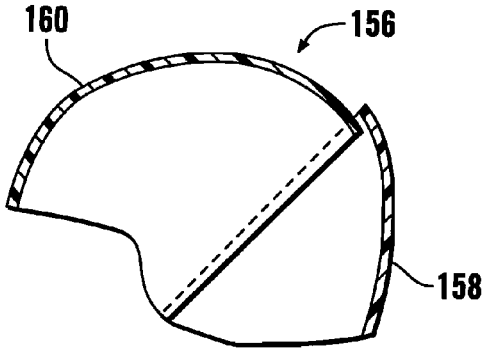
FIG. 6 is a side elevational cross-sectional view of an alternative embodiment two-part ballistic helmet.
Figure 7:
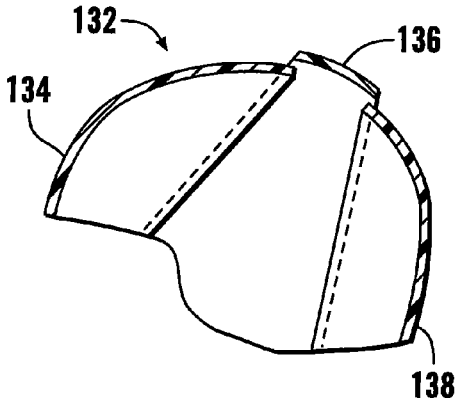
FIG. 7 is a side elevational cross-sectional view of another alternative embodiment three-part ballistic helmet.
Figure 8:
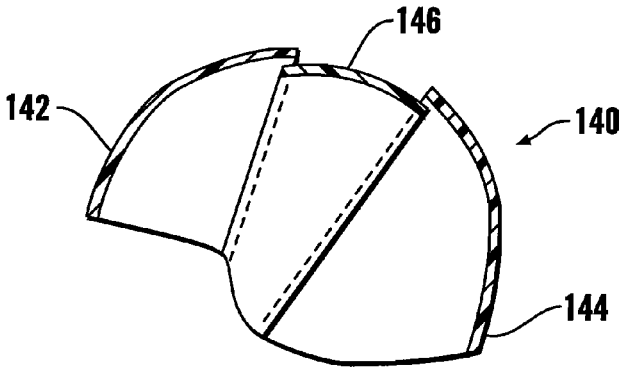
FIG. 8 is a side elevational cross-sectional view of yet another alternative embodiment three-part ballistic helmet.
Figure 9:
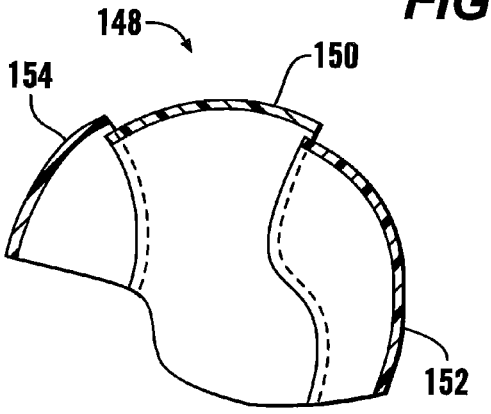
FIG. 9 is a side elevational cross-sectional view of a yet further alternative embodiment three-part ballistic helmet.
Figure 10:
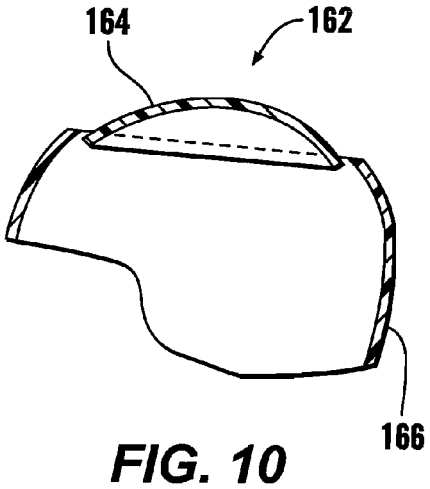
FIG. 10 is a side elevational cross-sectional view of another alternative embodiment two-part ballistic helmet of this invention.

Alternative embodiment helmets of this invention are shown in FIGS. 4 to 10. As shown in FIGS. 2 and 3, a ballistic helmet 120 may be comprised of three shell elements, a left portion 122, a middle portion 124, and a right portion 126. Ventilation gaps 128, 130 are defined where the left and right portions 122, 126 are fastened to the middle portion 124, either by rivets or other fasteners, or by adhesive or other bonding. As shown in FIG. 7, a ballistic helmet 132 may have a front portion 134, a middle portion 136, and a rear portion 138. The middle portions 124, 136, of the helmets 120, 132 may be positioned above the other two portions, or, as in the helmet 140, shown in FIG. 8, the front portion 142 and the rear portion 144 may both overlie the middle portion 146. Alternatively, as in the helmet 148 shown in FIG. 9, the middle portion 150 may overlie the rear portion 152, while the front portion 154 overlies the middle portion.

Two-part helmets may have the front portion overlie the rear portion, as shown in FIG. 3, or a helmet 156 may have the rear portion 158 overlie the front portion 160, as shown in FIG. 6. Another helmet 162, shown in FIG. 10, has a top portion 164 which is engaged with a peripheral side portion 166.

It will be noted that where the distinct shell elements or helmet portions come together to define a ventilation gap there is preferably a ballistic overlap. In other words, the gap is defined by the two surfaces being spaced apart from each other in a way that does not allow a direct passage of a projectile through the gap to the wearer's head. As shown in FIG. 3, one of the portions overlaps the other such that an entering projectile will strike one or the other of the connected helmet portions, or will strike the interior of the helmet, but will not first strike the wearer's head.

It should also be understood that the parts of the helmet, whether two, three or more parts, can be connected to each other by rivets, bolts or other common joining hardware, by bonding, by webbing, by flanges or by resilient or elastic members. Alternatively, the helmet parts may be formed with a snap-fit connection, or by use of keyed parts which fit into grooves on the opposing part.

Figure 14:
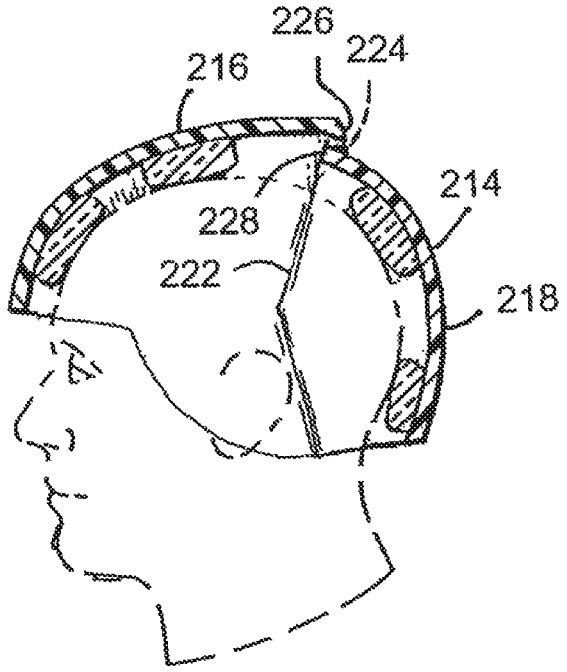
FIG. 14. is a cross-sectional view of another alternative embodiment ballistic helmet of this invention showing in phantom view the portion of a preform which is removed by machining to form a ventilation gap.

As shown in FIG. 14, a single ballistic shell 214 may be formed with a step between a first shell element 216 and a second shell element 218, and a ventilation gap 222 may be formed by routing or otherwise cutting away the material 224 between the two portions to leave a ventilation gap 222. A single molded preform is molded in which the first shell element 216 and the second shell element 218 are a unitary part. Within the mold a step is defined by the material 224, and when the material is partially or entirely removed, the first shell element has a first edge 226, and the second shell element has a second edge 228 which is spaced inwardly from the first shell element exterior surface. The second edge 228 is offset from the first edge 226 such that the first shell element overlaps the second shell element along the ventilation gap 222. The unitary part may be formed by layering up separately ballistic fabric layers for the first shell and the second shell.

Figure 11:
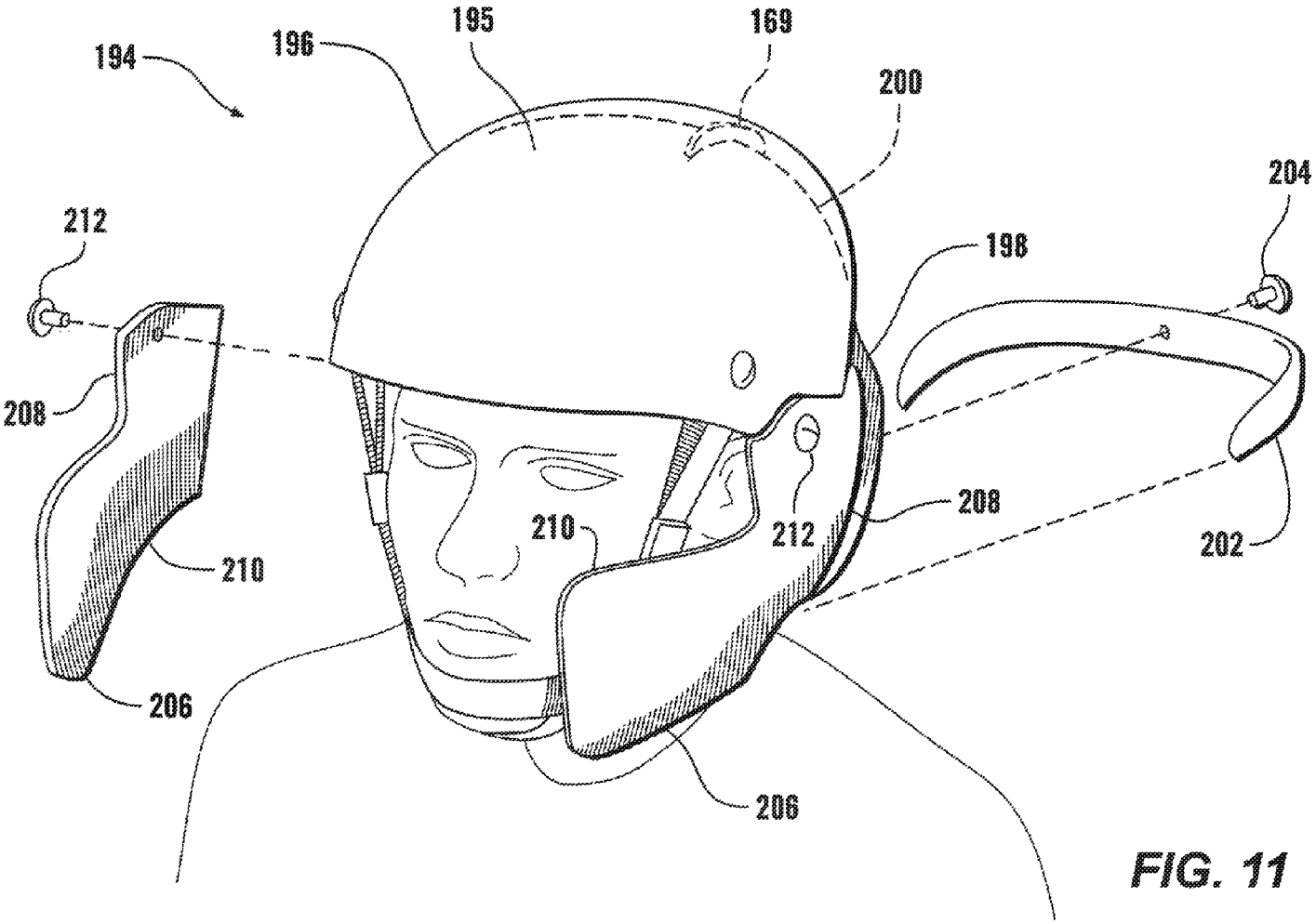
FIG. 11 is a side elevational illustrative view of still another three-part ballistic helmet with nape protector, and a face shield.
Figure 12:
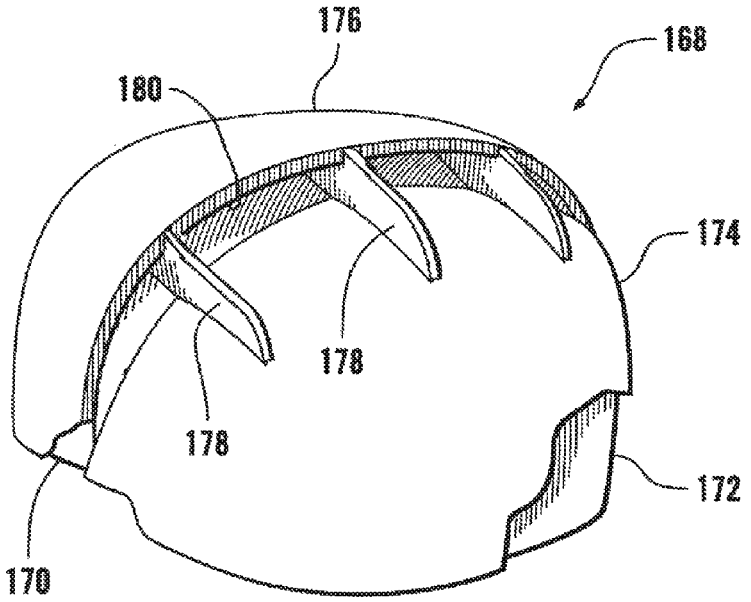
FIG. 12 is a rear isometric view, partially broken away in section, of an alternative embodiment ballistic helmet in which two helmet portions are connected by a continuous hard plastic skin.
Figure 13:
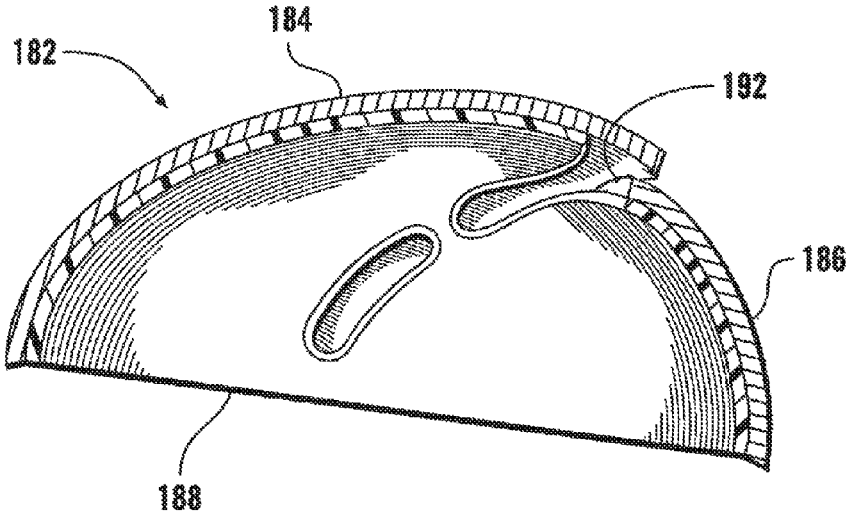
FIG. 13 is a cross-sectional view of another alternative embodiment ballistic helmet of this invention, in which two helmet portions are joined by an inner continuous liner.

In a preferred embodiment, the gap at the top of the helmet will be about one quarter inch, and then will taper to being flush at the edges of the gap. It should be noted that preferably the different shell elements are formed to have steps to bring about the desired spacing at the gap, but alternatively an additional spacer 169 may be bolted or bonded between the shell elements to obtain the desired spacing, as shown in FIG. 11. An alternative embodiment helmet 168 is shown in FIG. 12, showing how a helmet front portion 170 is joined to a helmet rear portion 172 by a continuous skin of hard plastic 174 which is a single piece outer shell 176 which has molded-in ribs 178 which join the front portion and the rear portion and allow air to pass through the vent 180 defined by the offset between the portions. The front portion 170 and rear portion 172 may be joined to the outer shell 176 by gluing. The front portion 170 and rear portion 172 are ballistic helmet sections constructed as described for the other embodiments, but the skin 174 need not have significant ballistic protection, functioning primarily as a connector or fastener between the two helmet portions. Alternatively, in a similar fashion, shown in FIG. 13, a ballistic helmet 182 having a front portion 184 and a rear 186 portion, may include an inner continuous plastic liner 188 to which the two helmet portions are mounted. The liner 188 has vent holes 190 formed in it to allow air to pass through the venting gap 192 defined between the front portion 184 and rear portion 186. The liner 188 may be adhesively attached to the front portion 184 and the rear portion 186.

As shown in FIG. 11, a ballistic helmet assembly 194 may be a modular arrangement of parts which allow the helmet assembly to be configured for particular uses and threats. A particular user can assess the relative value of added protection versus the additional weight and encumbrance of more parts. The helmet assembly 194 has a front helmet portion 196 which is fixed to a rear helmet portion 198 with a gap 200 therebetween. The front helmet portion 196 and rear helmet portion 198 define a ballistic helmet 195. A ballistic nape protector 202 may be mounted to the helmet rear portion 198 by bonding or by a removable fastener 204. The nape protector 202 is a shallow curved strip of ballistic material which is fastened along the rear edge of the helmet rear portion 198 to extend the coverage of the assembly 194 to the nape of the neck beneath the main ballistic helmet. The assembly 194 may further be provided with one or two side wings 206 which may be fastened, removably or otherwise, to the rear portion 198 or to the front portion 196. Each side wing 206 is fashioned of ballistic material, for example the same material from which the helmet portions are fabricated, and has a vertical part 208 which extends downwardly to a position below the user's ear, and a front part 210 which projects frontwardly from the vertical part to shield a portion of the user's cheek and provide additional sideward protection. With both side wings 206 in place the front of the user's face is still unobstructed, as there is a substantial gap between the front parts 210 of the side wings, leaving the user free to speak, eat, and breath without significant obstruction. Although side wings 206 may be worn on both sides for the additional ballistic protection offered, a user may choose to omit one of the side wings in order to have more effective access to a rifle, allowing the user to rest one cheek on the rifle stock, while still having the opposite cheek protected. The side wings 206 may be attached by one or more fasteners 212 such as bolts, or may be more permanently connected such as by adhesive or other bonding.

Although a number of small pads fixed to each of the shell elements is illustrated, it should be noted that a single encircling headband strap may be provided which is fixed to the shell elements, similar to those used in conventional hardhats. The headband strap is then fixed at several locations to the helmet.

As illustrated by the various embodiments, it is desirable that the ventilation gap or gaps be positioned towards the top of the helmet and the user's head. Hence it is desirable that each helmet portion be at least 20 percent of the total surface area of the helmet, so that the ventilation gap is not too close to the edge. In a helmet with three or more sections, it is desirable that the ventilation gaps between the helmet sections be generally evenly spaced.

It should be noted that, although the present invention particularly facilitates fabrication of the helmet portions from ballistic fabric sheets, the helmet portions may be formed in alternative manufacturing processes that do not involve sheets of ballistic fabric, such as molding of the entire helmet portion in some type of molding process.

The front portion of the helmet may be connected to the rear portion of the helmet by a plurality of fasteners along the gap between the two portions, with fasteners being positioned at each of the lower edges, and a single fastener extending through a wedge or spacer, such as the spacer 169 shown in FIG. 11.

It is understood that the invention is not limited to the particular construction and arrangement of parts herein illustrated and described, but embraces all such modified forms thereof as come within the scope of the following claims.

We claim:

1. A ballistic helmet for protecting portions of a wearer's head against bullets or shrapnel, the ballistic helmet having an exterior surface which faces away from the head of a wearer, the ballistic helmet comprising:

a first shell element formed of a ballistic material, and having an exterior surface, the first shell element exterior surface defining at least 20 percent of a total exterior surface of the helmet, wherein the first shell element has a first edge; and a second shell element formed of a ballistic material, the second shell element having portions extending beneath the first shell element, the second shell element being fixed to the first shell element and wherein the second shell element portions and the first shell element define a ventilation gap therebetween, the ventilation gap communicating with a first region defined within and below an interior of the first shell element, the second shell element having an exterior surface defining at least 20 percent of the total exterior surface of the helmet, and wherein the second shell element portions define a second edge terminating said second shell element portions which is spaced inwardly toward the first region from the first shell element first edge, the second edge being offset below the first edge such that the first shell element overlaps and is spaced from the second shell element along the ventilation gap, the first shell element interior surface being spaced apart from the second shell exterior surface in a way that does not allow a direct passage of a projectile through the ventilation gap to the wearer's head, and wherein the ventilation gap has edges spaced on opposite sides of the first region, and wherein the ventilation gap tapers to being flush at the edges of the gap.

2. A ballistic helmet for protecting portions of a wearer's head against bullets or shrapnel, the ballistic helmet comprising:

a composite first shell element formed of a ballistic fabric in a thermoset or thermoplastic matrix, the first shell element having an exterior surface;

a second shell element formed of a ballistic fabric in a thermoset or thermoplastic matrix, the second shell element being nonadjustably fixed to the first shell element inwardly of the first shell element towards a wearer's head to define a ventilation gap therebetween, the ventilation gap extending in a direction outwardly from the wearer's head;

a harness connected at a plurality of attachment points to the first shell element and the second shell element, the harness being engagable with the head of a wearer of the helmet;

wherein the first shell element has a first edge and wherein the second shell element has a second edge which is spaced inwardly from the first shell element exterior surface, the second edge being offset from the first edge such that the first shell element overlaps the second shell element along the ventilation gap; and a spacer bolted or bonded between the first shell element and the second shell element within the ventilation gap to define a selected spacing therebetween, wherein the ventilation gap has edges spaced on opposite sides of a topmost portion of the ventilation gap, and wherein the ventilation gap tapers to being flush at the edges of the gap.

3. A ballistic combat helmet having an exterior surface which faces away from a head of a wearer, the ballistic combat helmet comprising:

a first shell element formed of a ballistic material, and having an exterior surface, the first shell element exterior surface defining at least 20 percent of the total exterior surface of the helmet;

a second shell element formed of a ballistic material, the second shell element being fixed to the first shell element to define a ventilation gap therebetween, the second shell element defining at least 20 percent of the total exterior surface of the helmet; and a connecting element which extends between the first shell element and the second shell element, the connecting element overlying the first shell element and the second shell element, and having at least one rib which extends across the ventilation gap.

4. A ballistic combat helmet having an exterior surface which faces away from a head of a wearer, the ballistic combat helmet comprising:

a first shell element formed of a ballistic material, and having an exterior surface, the first shell element exterior surface defining at least 20 percent of the total exterior surface of the helmet;

a second shell element formed of a ballistic material, the second shell element being fixed to the first shell element to define a ventilation gap therebetween, the second shell element defining at least 20 percent of the total exterior surface of the helmet; and a connecting element which extends between the first shell element and the second shell element, the connecting element underlying the first shell element and the second shell element, and having at least one opening which underlies the ventilation gap.

5. The ballistic helmet of claim 1 wherein the ventilation gap above the first region extends in a direction outwardly from the wearer's head one quarter inch.

6. The ballistic helmet of claim 2 wherein the ventilation gap extends in the direction outwardly from the wearer's head one quarter inch.

* * * * *